United States Patent [19]

Nagashima

[11] Patent Number: 4,896,426

[45] Date of Patent: Jan. 30, 1990

[54] VIBRATION-ISOLATING ATTACHMENT MEANS FOR HANDLE OF CHAIN-SAW

[75] Inventor: Akira Nagashima, Kawasaki, Japan

[73] Assignee: Kioritz Corporation, Tokyo, Japan

[21] Appl. No.: 166,535

[22] Filed: Mar. 10, 1988

[30] Foreign Application Priority Data

Mar. 18, 1987 [JP] Japan ..... 62-39704[U]

[51] Int. Cl.[4] ..... B27B 17/02

[52] U.S. Cl. ..... 30/383; 173/162.2

[58] Field of Search ..... 30/381–387; 173/162.2

[56] References Cited

U.S. PATENT DOCUMENTS

| | | | |
|---|---|---|---|
| 3,728,793 | 4/1973 | Makinson et al. | 30/383 |
| 3,845,557 | 11/1974 | Bailey | 30/383 |
| 3,945,119 | 3/1976 | Nagashima et al. | 30/383 |
| 4,135,301 | 1/1979 | Hoeppner | 30/383 |
| 4,202,096 | 5/1980 | Nagashima | 30/381 |
| 4,296,553 | 10/1981 | Dirks et al. | 30/383 |
| 4,670,985 | 6/1987 | Biersteker | 30/383 |

FOREIGN PATENT DOCUMENTS 2911498 10/1980 Fed. Rep. of Germany .

*Primary Examiner*—Douglas D. Watts
*Attorney, Agent, or Firm*—Browdy & Neimark

[57] ABSTRACT

Vibration-isolating attachment means for a handle of a chain-saw wherein one end portion of a hollow vibration isolating rubber is fitted around the periphery of a recess formed on the main body of the chain-saw while the other end portion of said vibration isolating rubber is connected to the handle, and a stopper whose distal end is disposed within said recess is provided extending from the inner side of a cavity of said vibration isolating rubber toward the handle.

11 Claims, 1 Drawing Sheet

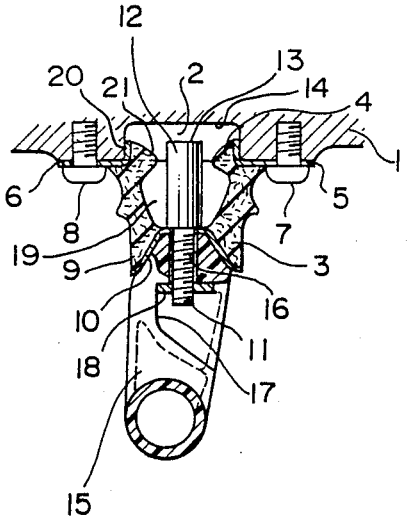
12
20
21
2
13
14
4
1
6
5
8
7
19
9
3
10
16
18
11
17
15

VIBRATION-ISOLATING ATTACHMENT MEANS FOR HANDLE OF CHAIN-SAW

BACKGROUND OF THE INVENTION

The present invention relates to vibration-isolating attachment means for a handle of a chain-saw.

Conventionally, various measures taken to attach the lower end of the front handle of a chain-saw to the side portion of the chain-saw main body are well know. For example, in certain vibration-isolating means for the handle of the chain-saw, a cylindrical vibration isolating rubber is provided interposing between the chain-saw main body and the front handle, and fastening screws extending outwardly from both ends of the vibration isolating rubber are screwed into the lower end portions of the chain-saw main body and the front handle to be fixed while the front handle is connected through a wire to the chain-saw main body. Thus the chain-saw main body is usually held by the vibration isolating rubber, whereas when the vibration isolating rubber is damaged the wire will protect the chain-saw main body and the front handle from being separated with each other, thereby preventing a subsidiary accident of the chain-saw and assuring the security for the operator.

In those attachment means, however, there remains the problems such as the wire has to be provided connecting between the chain-saw main body and the front handle, and it is necessary to repeatedly ascertain by the operator a condition of the wire to be held for enabling the connection between them upon emeregency.

SUMMARY OF THE INVENTION

Accordingly, one object of the present invention is to solve these defects in the conventional prior arts and provide an improved vibration-isolating attachment means of simple and convenient type for the handle of a chain-saw.

That is to say, the vibration-isolating attachment means for the handle of the chain-saw according to the present invention is characterized in that a recess is formed on the main body of the chain-saw, one end portion of a hollow vibration isolating rubber is fitted around the periphery of the recess while the other end portion of the vibration isolating rubber is connected to the handle, and in that a stopper whose distal end is disposed within the recess is provided extending from the inner side of a cavity within the vibration isolating rubber toward the handle.

According to the structure as has been described above, the stopper thus restricts the displacement of the vibration isolating rubber, and the stopper also engages with the inner wall within the recess of the chain-saw main body so as to prevent the separation, upon the breakage of the vibration isolating rubber, between the chain-saw main body and the handle. In this manner, according to the arrangement of the present invention, on one hand, the stopper can abut against the vibration isolating rubber to minimize its deformation protecting it from breakage when the excessive displacement of the vibration isolating rubber occurs; and on the other hand, when the vibration isolating rubber breaks the stopper can engage the inner wall within the recess of the main body, so that the connection between the chain-saw main body and the handle is ensured, whereby the operator is protected from serious dangerous accident.

BRIEF DESCRIPTION OF THE DRAWING

The FIGURE is transverse cross-sectional view showing a main part of vibration-isolating attachment means for the handle of a chain-saw in accordance with one embodiment of the present invention.

DESCRIPTION OF THE PREFERRED EMBODIMENT

The present invention will be fully described hereinafter with reference to the drawing showing one preferred embodiment.

In the illustrated embodiment, the main body 1 of a chain-saw has a circular recess 2 formed at the lower portion on one side of the chain-saw. A generally cylindrical hollow vibration isolating rubber 3 is so disposed as to fit its one end portion 4 into such a recess 2. A pair of attachment lugs 5 and 6 extending laterally are fixed together with one end portion 4 of the vibration isolating rubber by baking, which attachment lugs 5 and 6 are mounted on the main body 1 of the chain-saw adjacent to the recess 2 by means of screw fasteners 7 and 8 threaded into the side surface of the chain-saw main body 1.

Further, it is preferably to manufacture those attachment lugs 5 and 6 integral with an annular wall 20 as a single piece to be fitted in the recess 2 by stamping it from a steel plate.

A cup-shaped attachment plate 10 flaring outwardly is connected by baking to the other end portion 9 of the vibration isolating rubber 3. The attachment plate 10 includes a screw member 11 which extends outwardly passing through a hole formed at the central portion of the attachment plate 10. The screw member 11 has a rod-like stopper 12 formed integrally therewith extending from the attachment plate 10 through the inner cavity 19 within the vibration isolating rubber 3 into the recess 2 of the chain-saw main body 1. The rod-like stopper 12 has a length so that when the vibration isolating rubber 3 is not being compressed, the distal end portion1 3 of the stopper 12 is in the recess 2 and extends at a suitable distance apart from the bottom surface 14 of the recess 2, whereas when excessive force has been applied to the vibration isolating rubber 3, this distal end portion 13 abuts against the bottom surface 14 of the recess 2 to restrict the maximum displacement of the vibration isolating rubber 3. The screw member 11 protrudes into a laterally-opened concaved portion 17 by passing through a hole 16 formed at the lower end portion of a front handle 15 which is made from a material such as synthetic resin and fitted into the attachment plate 10. The screw member 11 is also engaged with a plate-like nut 18 within the concaved portion 17 so that the handle 15 is connected to the other end portion 9 of the vibration isolating rubber 3 through the attachment plate 10.

According to the arrangement of the prescribed embodiment, the vibration occurring in the chain-saw main body 1 during operation can be absorbed by the vibration isolating rubber 3, so that the vibration is not transmitted to the front handle 15 the operator grasps. In case of accident such as breakage the vibration isolating rubber 3, the distal end 13 of the stopper 12 will be brought into contact with the inner wall of the recess 2 of the chain-saw main body to prevent the handle from being dislodged from the chain-saw main body 1.

Furthermore, as illustrated in the drawing, when the vibration isolating rubber 3 is provided at a location close to the distal end 13 of the stopper 12 with opposite annular convex portions 21, it is advantageously possible to further improve the capability for isolating vibration from the rubber 3 and increase its strength.

Additionally, in an alternative embodiment (not shown), the screw member 11 used in the above-mentioned embodiment may be replaced with a tapping screw. If such a tapping screw is used, it is screwed into the lower end of the front handle 15 from the side of the attachment plate 10 to secure the handle 15, so that the concaved portion 17 and the plate-like nut 18 can be eliminated.

What is claimed is:

1. Vibration-isolating attachment means for a handle of a chain-saw characterized in that a circular recess is formed on the main body of the chain-saw, one end portion of a cylindrical hollow vibration isolating rubber is fitted around the periphery of said recess while the other end portion of said vibration isolating rubber is connected to the handle, and in that a stopper whose distal end is disposed within said recess is provided extending from the inner side of a cavity within said vibration isolating rubber toward the handle and said hollow vibration isolating rubber is formed with opposite annular convex portions adjacent to the distal end of said stopper.

2. A vibration-isolating attachment means for attaching a handle of a chain-saw to a chain-saw body, said attachment means comprising a cylindrical hollow vibration isolating rubber element having a first end and a second end, said first end being adapted to fit around and within the periphery of a circular recess having a bottom wall formed in the main body of the chain saw and having first connecting means thereon for connecting said first end of said vibration isolating rubber element to the chain-saw body about the recess, said second end of said vibration isolating rubber element being adapted to and having second connecting means for connecting said vibration isolating rubber element to the handle; and a rigid elongated stopper having a fixed end and a free end, said stopper having its fixed end projecting generally axially from said second end of said vibration isolating rubber element within said vibration isolating rubber element with an annular space therebetween so that said free end extends into the recess and terminates above the recess bottom wall when said vibration-isolating attachment means is in use connecting the handle to the main body of the chain saw.

3. A vibration-isolating attachment means according to claim 2 wherein said hollow vibration isolating rubber element is formed at said first end with opposite annular convex portions adjacent to the free end of said stopper.

4. A vibration-isolating attachment means according to claim 2 wherein said first connecting means comprises a pair of attachment lugs (5, 6) extending laterally from said vibration isolating rubber element.

5. A vibration-isolating attachment means according to claim 4 wherein said first connecting means further comprises a metal plate having an annular wall (20).

6. A vibration-isolating attachment means according to claim 2 wherein said second connecting means comprises a generally cup-shaped attachment plate (10).

7. In a portable chain saw having a main body, a handle and means for connecting said handle to said main body, the improvement wherein said means for connecting said handle to said main body comprises a vibration-isolating attachment construction including a cylindrical hollow vibration isolating rubber element having a first end and a second end, said first end fitting around and within the periphery of a circular recess having a bottom wall formed in said main body of said chain saw and having first connecting means thereon for connecting said first end of said vibration isolating rubber element to said chain saw body about the recess, said second end of said vibration isolating rubber element having second connecting means for connecting said vibration isolating rubber element to said handle; and a rigid elongated stopper having a fixed end and a free end, said stopper having its fixed end projecting generally axially from said second end of said vibration isolating rubber element within said vibration isolating rubber element with an annular space therebetween so that said free end extends into said recess and terminates above said recess bottom wall.

8. A portable chain saw according to claim 7 wherein said hollow vibration isolating rubber element is formed at said first end with opposite annular convex portions adjacent to the free end of said stopper.

9. A portable chain saw according to claim 7 wherein said first connecting means comprises a pair of attachment lugs (5, 6) extending laterally from said vibration isolating rubber element.

10. A portable chain saw according to claim 9 wherein said first connecting means further comprises a metal plate having an annular wall (20).

11. A portable chain saw according to claim 7 wherein said second connecting means comprises a generally cup-shaped attachment plate (10).

* * * * *